United States Patent [19]

Chiang et al.

[11] Patent Number: 4,803,006

[45] Date of Patent: Feb. 7, 1989

[54] STRONGLY MAGNETIC ORGANIC SOLID STATE COMPOSITION OF MATTER

[75] Inventors: Long Y. Chiang, Somerset; Aaron N. Bloch, Bridgewater, both of N.J.

[73] Assignee: Exxon Research and Engineering Company, Florham Park, N.J.

[21] Appl. No.: 66,704

[22] Filed: Jun. 26, 1987

Related U.S. Application Data

[63] Continuation-in-part of Ser. No. 853,661, Apr. 18, 1986, abandoned.

[51] Int. Cl.[4] ..... H01F 1/00

[52] U.S. Cl. ..... 252/62.51; 252/500; 252/518

[58] Field of Search ..... 252/500, 62.51, 518

[56] References Cited

U.S. PATENT DOCUMENTS 4,478,751 10/1984 Jonas et al. ..... 252/500
4,501,686 2/1985 Hotta et al. ..... 252/500
4,568,494 2/1986 Jonas et al. ..... 252/500
4,684,598 8/1987 Potember et al. ..... 252/500

OTHER PUBLICATIONS

Eckhardt et al., "Conducting Polymers Synthesized by Dopant-Induced Polymerization of Insulating Charge-Transfer Crystals", Chem. Abst. 101 (22) 202275h, p. 661.

*Primary Examiner*—John F. Niebling
*Assistant Examiner*—Steven P. Marquis
*Attorney, Agent, or Firm*—Joseph J. Dvorak

[57] ABSTRACT

The present invention is an organic composition of matter having paramagnetic or ferromagnetic properties, wherein the composition includes a donor molecule and an acceptor molecule in a mix-stacked form and a dopant with an electron affinity so as to generate a ground state molecule with an appreciable triplet character. Also included is a method for preparing such a composition of matter.

10 Claims, 5 Drawing Sheets

STRONGLY MAGNETIC ORGANIC SOLID STATE COMPOSITION OF MATTER

CROSS-REFERENCE TO CO-PENDING APPLICATION

This is a continuation-in-part of U.S. Ser. No. 853,661, filed Apr. 18, 1986 now abandoned.

BACKGROUND OF THE INVENTION

The present invention is an organic material that is strongly magnetic.

Until now, organic ferromagnetic or strongly magnetic materials that are stable solids at temperatures above about 200° K have not been synthesized. Theoretically, it has been speculated that organic molecules having appropriate ground state triplet spins are good candidates for the synthesis of potential organic paramagnets or ferromagnets. This type of ground triplet state spins in a molecule can be in the form of either biradical, for a review see Borden, W. T., "Diradicals" published by Wiley-Interscience (1982), cyclopentadienyl cation radical, for a review see Breslow, R., "Topics in Nonbenzenoid Aromatic Chemistry" (edited by T. Nozoe, R. Breslow, K. Hafner, S. Ito, and I. Murata), Vol. I, p. 81, Hirokawa, Tokyo (1973), polycarbene, Sugawara, T., Bandow, S.; Kimura, K.' Iwamura, H. *J. Am. Chem. Soc.* 1985 107, 5293–4, or dication radical, Bechgaard, K.; Parker, V. D. *J. Am. Chem. Soc.* 1972, 94, 4749–50; Breslow, R. *Pure & Appl. Chem.* 1982, 54, 927–38; Breslow, R., Jaun, B.; Kluttz, R., Xia, C. *Tetrahedron* 1982, 38, 863–67; Breslow, R.; Maslak, P.; Thomaides, J., *J. Am. Chem. Soc.* 1984, 106, 6543–4. Several models, McConnell H. *Proc. R. A. Welch Found. Conf.* 1967, 11, 144–45; McConnell, H. M. *J. Chem. Phys.* 1963, 39, 1910; Ovchinnikov, A. A. *Dokl. Akad. Nauk SSSR* 1977, 236, 928; Ovchinnikov, A. A. *Theor, Chim. Acta* 1978, 47, 297; Buchachenko, A. L. *Dokl. Akad. Nauk SSSR* 1979, 244, 1146–49, have been considered and reported for organic ferromagnets. Among them most of attention was attracted on the theoretical model proposed in a very brief communication by McConnell stating that the positive and negative ion molecules forming alternating linear sequence, $D^+A^-D^+A^-$—, with neutral donor or neutral acceptor molecule spins in a ground triplet state will have possibility to achieve a ferromagnetic coupling of the spins. This model was interpreted by Breslow to consist of parallel spins on two neighboring species $D^+$ and $A^-$, so that charge transfer between D and A molecules favors the formation of a triplet state of one of the partners leading such parallel spin correlation to a ferromagnetic domain as shown in equilibrium (a) and (b) of FIG. 1. Breslow extends this model to introduce dications with triplet ground state as a component for the generation of organic ferromagnetism as shown in equilibrium (c) of FIG. 1. The system includes the suitable selection of an acceptor with at least $C_3$ symmetry capable of accepting two electrons from donor. Experimentally, some examinations on these models have been performed in the solid state by Breslow, Breslow, R. *Mol. Cryst. Liq. Cryst.* 1985, 125, 261–67, without success. Therefore, the McConnell and the Breslow model has not lead to organic strong paramagnetism or ferromagnetism.

SUMMARY OF THE INVENTION

The present invention is an organic solid state composition of matter having paramagnetic or ferromagnetic properties. The material includes a donor molecule and an acceptor molecule in a mix-stacked form and a dopant with an electron affinity so as to generate a ground state molecule with an appreciable triplet character (about 10% or higher triplet concentration). These compositions are solids stable at temperatures above about 200° K.

In a preferred embodiment, the donor molecule is selected from the group consisting of 2,3,6,7,10,11-hexaalkoxy triphenylene; 2,3,6,7,10,11-hexaaryloxy triphenylene; 2,3,6,7,10,11-hexa-p-alkylaryloxytriphenylene; 2,3,6,7,10,11-hexa-p-alkoxyaryloxytriphenylene; 2,3,6,7,10,11-triphenylene hexaalkanoate; 2,3,6,7,10,11-tris(N,N'-alkylenadiamino) triphenylene; or hexaazaoctadecahydrocoronene. In general the alkyl, alkoxy and alkanoate groups in the foregoing compounds have from 1 to about 13 carbon atoms. A proper dopant is selected which has the capability to form a closed-shell species after it is reduced. This type of dopant includes the group consisting of $X_2$ (halogen), $AsF_5$, $SbF_5$ and $NO^+X^-$wherein $X^-$is a univalent anion. Suitable univalent anions include $PF_6^-$, $AsF_6^-$, $BF_4^-$, halide, especially chloride and bromide. In a more preferred embodiment, the donor molecule is 2,3,6,7,10,11-hexamethoxytriphenylene (HMTP), the acceptor molecule is tetrafluorotetracyanoquinodimethane ($TCNQF_4$), and the dopant is $AsF_5$.

In yet another embodiment of the present invention, there is provided a method for preparing an organic solid state composition of matter having paramagnetic or ferromagnetic properties comprising contacting a composition having a donor molecule and an acceptor molecule in a mixed stack form with an effective amount of a dopant having an electron affinity capable of generating a ground state molecule with triplet character. Suitable dopants include halogen, $AsF_5$, $SbF_5$, and $NO^+X^-$wherein $X^-$is a univalent anion including $PF_6^-$, $AsF_6^-$-, $BF_4^-$- and halide anions.

DESCRIPTION OF THE PREFERRED EMBODIMENT

The present invention includes the preparation of strongly paramagnetic or ferromagnetic organic charge transfer salts with a high spin density. Organic magnetic materials have many electromagnetic applications including coatings. The invention is based on the manipulation of arraying ground state high spin radicals into an ordered matrix such that they are molecularly separated by a second set of radicals with a different spin state. If ground state high spin radicals can be physically separated from each other in three dimensions and meanwhile retain a certain degree of spin exchange through the selected lower spin species, one can expect to obtain a net unpaired high spin concentration in the material during nearby molecular spin exchanges. With this net high spin concentration in the solid matrix, the material should behave as a paramagnet. With decreasing temperature, these paramagnetic spins can undergo a net ferromagnetic ordering regardless of the sign of the spin-exchange between neighboring molecules.

Figure 1:
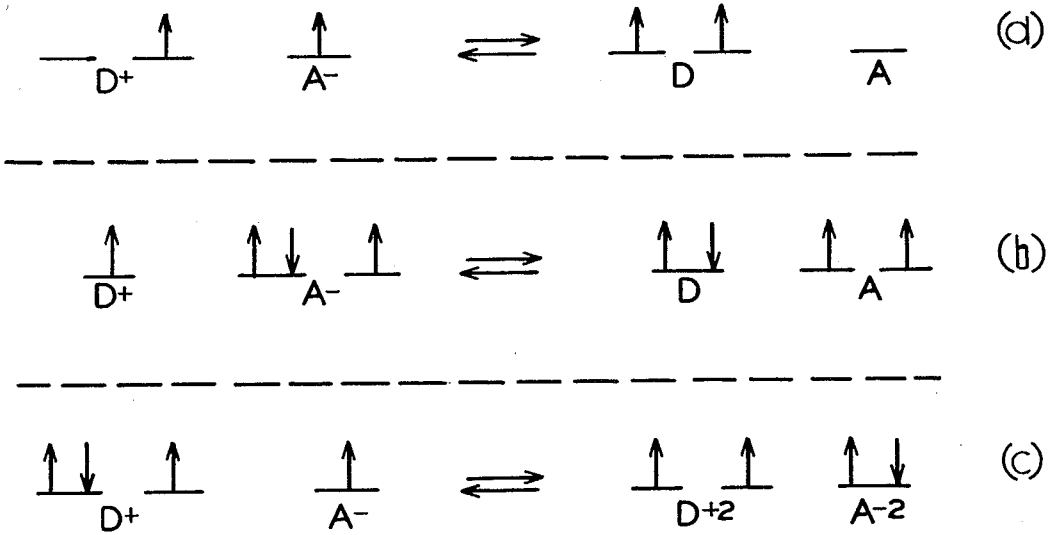
FIG. 1 shows some theoretical models proposed by McConnell and Breslow for organic ferromagnetics. magnetics.
Figure 2:
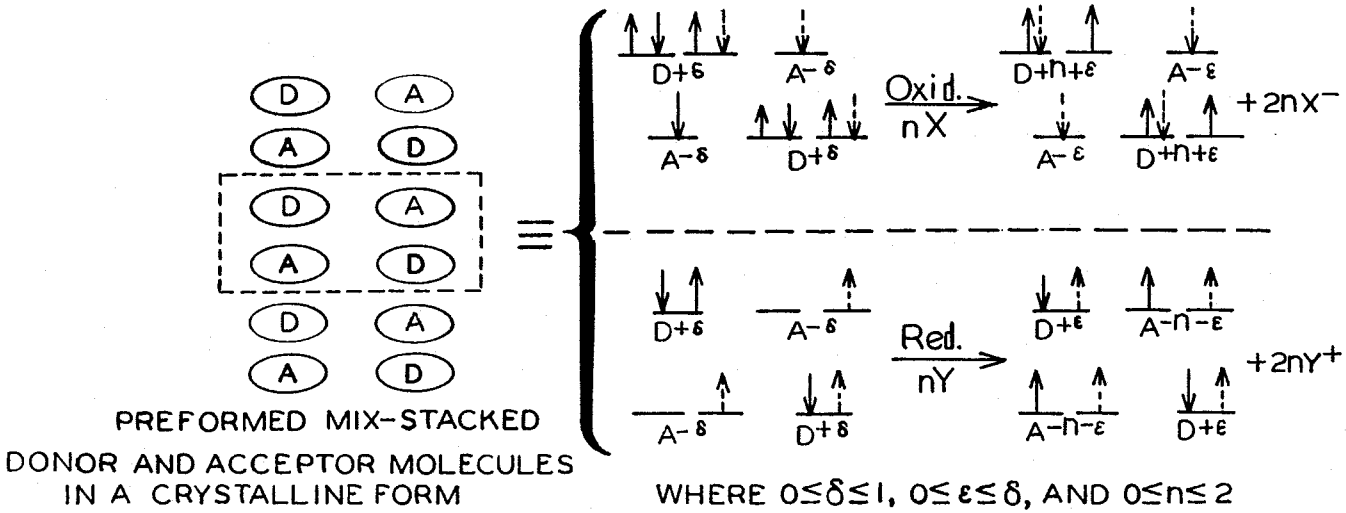
FIG. 2 shows the model for the generation of strong magnetism of the present invention.

This type of molecular engineering leads to a design of a mix-stacked organic donor-acceptor charge transfer salt in a microcrystallite matrix with a partial charge transfer (δ) between D and A molecules as shown in FIG. 2 In this case the mix-stacked sequence of D-A molecules, where D in FIG. 2 represents one or two donor molecules, offers advantages over the parallel segregated D-A stacked sequence. The former prevents the diamagnetic coupling between adjacent donor-donor or acceptor-acceptor molecules by the separation of donor or acceptor species with their counterpartners. It also allows the spin interaction through both the parallel space and the stacking column resulting in enhanced magnetic spin correlation.

In the present invention, the generation of full or partial ground state triplet spins is actually carried out by the external chemical doping on the preformed mix-stacked D-A complex. In other words, the mix-stacked D-A complex is contacted with a suitable dopant either in the vapor phase or in solution at temperatures and times sufficient to form a ground state molecule with a triplet character. Typically, this contacting can be done at ambient temperatures for times ranging from about 1 minute to about 3 hours or more. In any event, this external doping ensures the mix-stacked nature of the complex matrix remaining intact after the doping process. It also gives a flexibility to generate a different degree of magnetism on the material. The degree of magnetism created on this system depends upon the amount of external oxidation or reduction ($\eta$), i.e., the amount of dopant introduced. The resulting complex favors the formation of a ground state energy with an appreciable triplet character distributed between two states in equilibrium.

Figure 3:
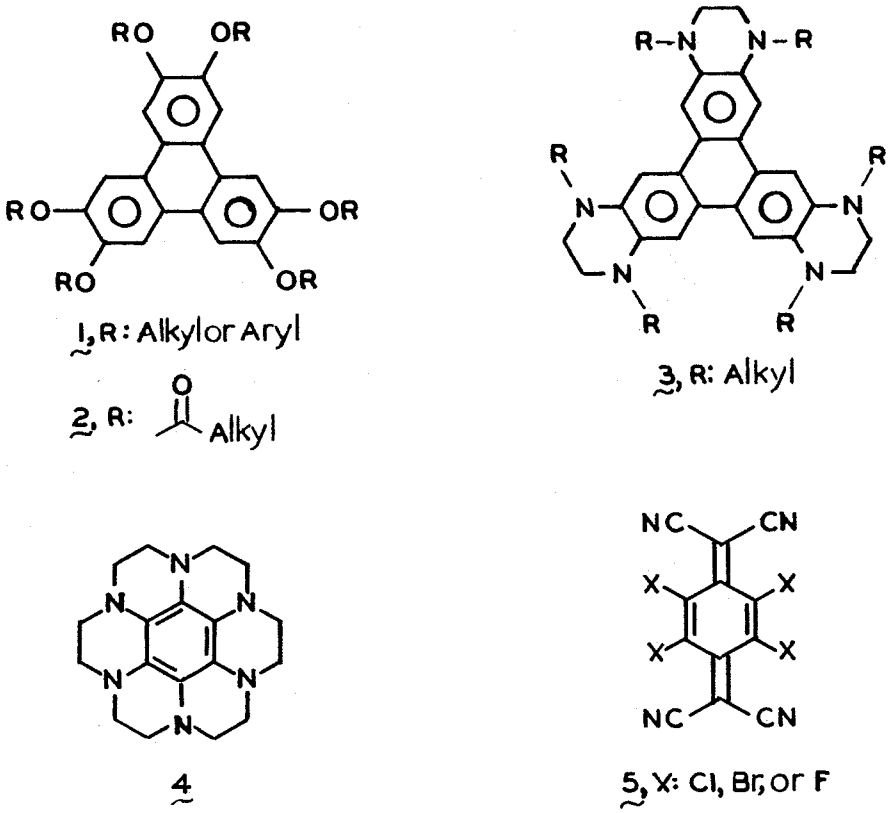
FIG. 3 shows several chemical compounds suitable for use in the present invention.

There are several ground state triplet organic molecules in a planar electron-rich aromatic structure with at least a $C_3$ symmetry, a low first oxidation potential, ($<+0.6$ V vs SCE), and a low second oxidation potential ($<+0.9$ V vs SCE) suitable for the present invention (shown in FIG. 3) such as 2,3,6,7,10,11-hexaalkoxy (or aryloxy) triphenylene; (1); 2,3,6,7,10,11-triphenylene hexaalkanoate (2); 2,3,6,7,10,11-tri(N,N'-alkylenediamino)triphenylene (3); and hexaazaoctadecahydrocoronene (4). Regarding (1), see Chiang, L. Y., Safinya, C. R., Clark, N. A., Liang, K. S., Block, A. N., *J. Chem. Soc. Chem. Commun.* 1985, 695.

From the study of charge transfer complex of organic metals, tetrafluoretectracyanoquinodimethane ($TCNQF_4$, 5, X=F) tends to form a mix-stacked salt when it is complexed with various organic donors. For preparation of $TCNQF_4$, see Wheland, R. C.; Martin, E. L. *J. Org. Chem.* 1975, 40, 3101. This unique tendency shows that $TCNQF_4$ is suitable as an acceptor. Indeed it forms a microcrystalline mix-stacked 1:2 ratio charge transfer salt with 2,3,6,7,10,11-hexamethoxytriphenylene (HMTP, 1, R=methyl). After a chemical doping on $(HMTP)_2$-$TCNQF_4$ (6) crystal with $AsF_5$ oxidant, we observe a paramagnetic high spin nature of the resulting complex, $(HMTP)_2$-$TCNQF_4$-$(AsF_x)y$ (7); in a solid state. This paramagnetism is enhanced upon the decrease of temperature from ambient temperature to 60° mK with only a very small negative Weiss temperature (−0.4° K) stable persistently down to 1° K. This material provides an example of organic bulk material in a solid state behaving as a strongly paramagnetic material in an entire temperature range from 300° K. to 60° mK.

These materials can be used in a variety of applications where paramagnetic or ferromagnetic materials are employed. Indeed, because of the nature of these materials, they can be used, in effect, as magnetic thermometers.

I. EXAMPLE 2,3,6,7,10,11-hexamethoxytriphenylene (1) was synthesized by known methods and purified by thin layer chromatography using chloroform as an eluent followed by recrystallization from chloroformethanol/5:1. Tetrafluorotetracyanoquinodimethane was synthesized according to known procedures. It was decolorized and recrystallized from methylene chloride. Commercial grade arsenic pentafluoride was purchased and used without further purification. Chloroform was purified by the filtration through a 110° C. baked alumina column. Acetonitrile was distilled over calcium hydride prior to use.

A. Preparation and Charge Transfer Complex Between 2,3,6,7,10,11-hexamethoxytriphenylene (HMTP, 1 R=Me) and Tetrafluorotetracyanoquinodimethane ($TCNQF_4$)

2,3,6,7,10,11-hexamethoxytriphenylene (816 mg 2 mmol) was dissolved in a chloroform solution (100 ml) at the refluxing temperature of chloroform. In a separated flask, tetrafluorotetracyanoquinodimethane (552 mg, 2 mmol) was dissolved in an acetonitrile solution. These two solutions were mixed together while the temperature was maintained at least 70° C. to ensure a homogeneous dispersion of materials. The mixture was then cooled to 0° C. to cause the precipitation of purple microcrystalline complex. This precipitation was completed by a slow evaporation of solvents. The resulting solid was washed repeatedly with acetonitrile (60 ml total) to afford shiny purple microcrystalline solids (1.1 g) in a nearly quantitative yield based on HMTP molecules used. The remaining acetonitrile washing was dried to recover an excess of $TCNQF_4$ (230 mg). This observation clearly indicated that the composition of HMTP-$TCNQF_4$ complex is in a ratio of 2:1; Anal. Calcd. for $C_{60}H_{48}O_{12}N_4F_4$: C, 65.93; H, 4.40; O, 17.58; N, 5.13; F, 6.96. Found: C, 64.87; H, 4.48; O, 18.92; N, 5.17; F, 6.28.

Needle crystals of $(HMTP)_2$-$TCNQF_4$ can be prepared by a diffusion method using a straight tube containing an acetonitrile solution of $TCNQF_4$ which was placed carefully on the top of a chloroform solution of HMTP. It takes normally one to two weeks to grow needle crystals 1–5 long. They can also be prepared by dissolving both HMTP and $TCNQF_4$ in a solvent mixture of chloroform and chlorobenzene, then slowly evaporating chloroform to yield complex crystals in chlorobenzene. Elemental analysis indicates that needle crystals have the same chemical composition as the microcrystalline form of complex.

B. Chemical Doping of $(HMTP)_2$-$TCNQF_4$ Complex with $AsF_5$

The cylinder of arsenic pentafluoride was equipped with multiple gas pressure control gauge meters, teflon valves, and teflon injection tubings for the safe handling of the arsenic pentafluoride gas. The system was also connected with a chemical trap containing an aqueous 5N solution of sdium hydroxide. $(HMTP)_2$-$TCNQF_4$ complex (328 mg, 0.3 mmol) was placed in a two-necked flask maintained under an inert atmosphere. A very slow flow of arsenic pentafluoride gas was introduced into the flask to allow the exposure of complex to $AsF_5$ for 'minutes to several hours. The purple color of complex turned to dark brown to black. The excess of AsF5 was removed by a continuous flow of inert gas and destroyed in the chemical trap. It was then pumped under vacuum for several hours to further remove residues of arsenic byproducts. The weight increase after doping was measured to be 120 mg to 500 mg.

II. RESULT AND DISCUSSION

In the study of organic charge transfer salts, it has been known that, in the case of tetracyanoquinodimethane (TCNQ) or $TCNQF_4$, the degree of charge transfer between donor and acceptor can be determined by the shift of cyano frequency in the IR spectrum, Chappel, J. S.; Bryden, W. A.; Maxfield, M.; Cowan, D. O.; Bloch, A. N. *J. Am. Chem. Soc.* 1981, 103, 2442. The amount of this frequency shift can be plotted in a linear relationship with the degree of charge transfer. We utilize the same method to calculate the degree of charge transfer in the salt of $(HMTP)_2$-$TCNQF_4$. The salt has a cyano (—CN) frequency at 2223 $cm^-$which is corresponding to the partial anion radical state of $TCNQF_4$ with negative 0.2 charges. This cyano frequency does not change during the chemical doping with $AsF_5$. Although the crystal has a very smooth shiny surface with sharp edges in appearance, X-ray diffraction gives only a very diffuse pattern. From that limited information along with the data obtained from X-ray powder diffraction of this sample, the crystal is monoclinic with a cell dimension of a=30 Å, b (very disorder), and c (stacking direction) =9.9 Å. It reveals a mix-stacked nature of HMTP and $TCNQF_4$ molecules in the crystal. The large disorder in one plane dimension can be understood by the fact that HMTP and $TCNQF_4$ are quite different in size and symmetry. In this particular combination of molecular ratio and stacking nature, the order in one dimension will certainly favor the disorder in the other dimension.

The doping process was carried out under various conditions. The best was to perform the doping of $(HMTP)_2$-$TCNQF_4$ complex at its solid state with an arsenic pentafluoride gas. Under this condition, the mix-stacked nature of the complex can be maintained without being disturbed. Elemental analysis indicated the contain of arsenic fluorides varied from 27 weight percent to 60 weight percent, which was corresponding to a molecular formula of $(HMTP)_2$-$TCNQF_4$-$(AsF_x)_{2\text{-}8.1}$ (7), depending on the length of doping period. It is generally speculated that the main fraction of arsenic fluorides incorporated in the crystal is a form of $AsF^-_6$ with absorbed $AsF_5$. This is supporte,d by the IR spectrum of the doped complex which showed two strong distinguished bands at 400 $cm^{-1}$ and 800 $cm^{-1}$ resemble to that of $AsF^-_6$ salts. However, more complicated reactions leading to other types of arsenic fluoride cannot be ruled out in this magnetic doping process.

III MAGNETIC PROPERTIES OF MATERIALS

The magnetic susceptibility ($\chi$) of complex (7 ) was measured at its solid state. In the measurement, the diamagnetic susceptibility ($\chi_o$) of the sample was determined by the $\chi$ vs. 1/T plot and the value $-7.53\times10^{-7}$ $cm^3/g$ was substracted from $\chi$ to obtain paramagnetic susceptibilities ($\chi_p=\chi\text{-}\chi_o$).

Figure 4:
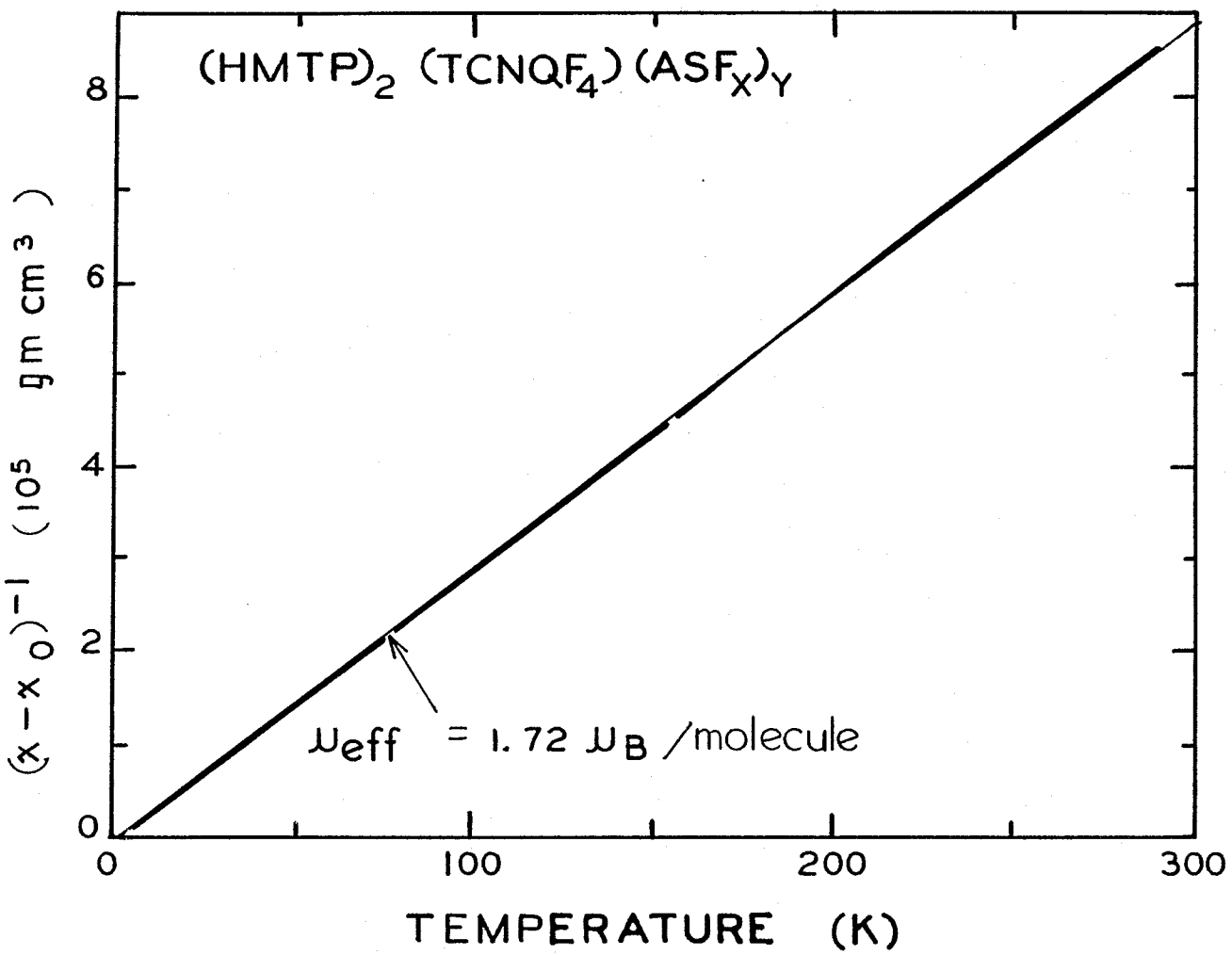
FIG. 4 shows the temperature dependence of the magnetic susceptibility of the material of the present invention.
Figure 5:
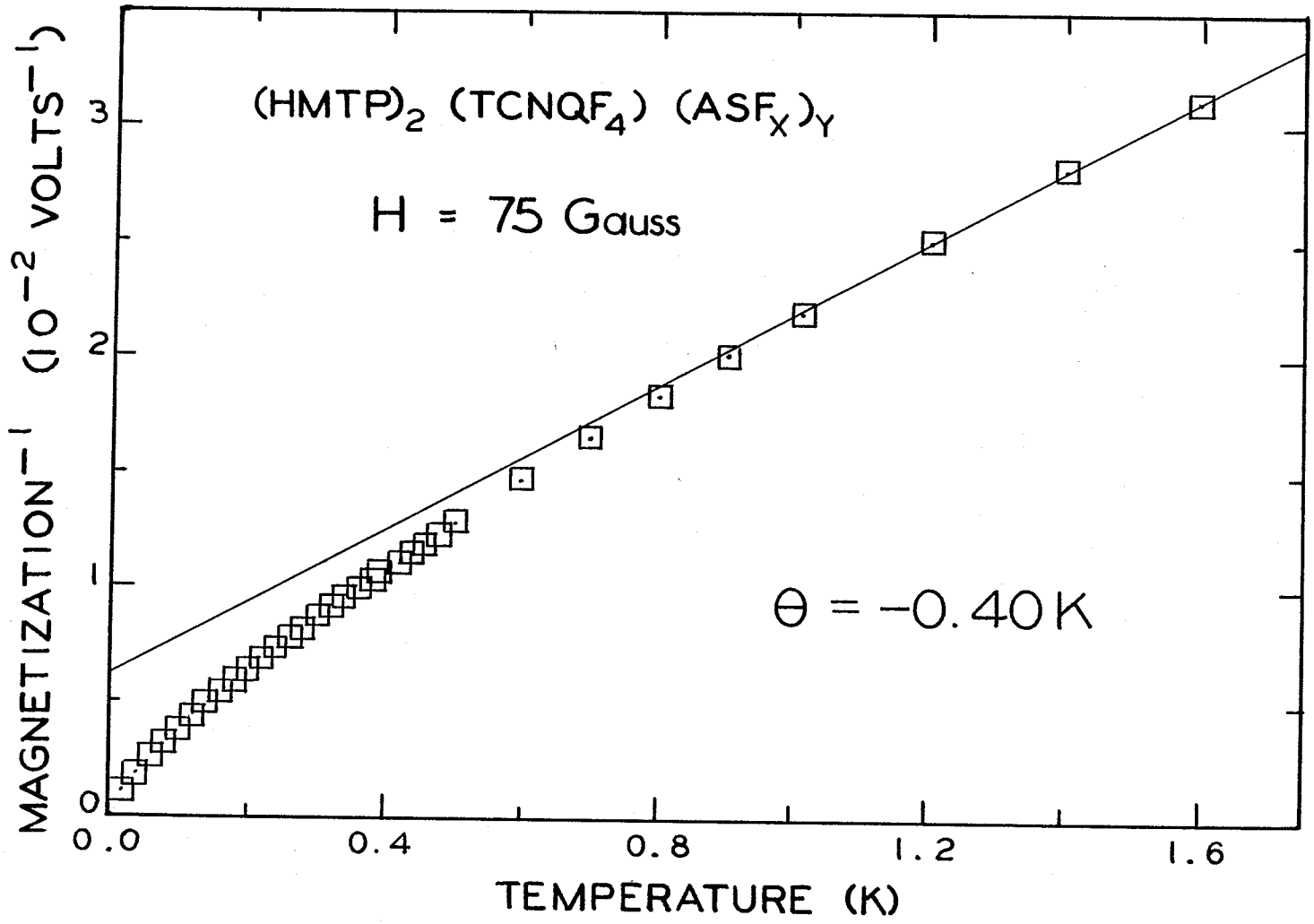
FIG. 5 shows the temperature dependence of the magnetic susceptibility of the material of the present invention below 1.6° K.

FIG. 4 showed a temperature (x-axis) dependence plot of reverse paramagnetic susceptibilities (y-axis) of complex (7) in a solid state. It gave a straight line in the entire temperature range from 4° K to 300° K The slop of this line $\mu_{eff}=1.72\ \mu_B$/complex molecule which was corresponding to a spin number of 1.0 per complex molecule. The extrapolation of this straight line seems to intercept origin indicating a strong paramagnetic nature of the individual magnetic moment in the solid state of this organic complex resemble to that of paramagnetic transition metals with unpaired electrons. Interestingly, the paramagnetic susceptibility at room temperature ($^{102}$R.T ) was found to be $1.2\times10^{-3}$ $cm^3$/mole which is comparable to that of nickel oxide ($0.66\times10^{-3}$ $cm^3$/mole) and chromium oxide ($Cr_2O_3$, $1.96\times10^{-3}$ $cm^3$/mole) and close to that of iron oxide ($Fe_2O_3$, $3.59\times10^{-3}$ $cm^3$/mole; FeO, $7.2\times10^{-3}$ $cm^3$/mole). The magnetic behavior below 4° K was examined. A continuous paramagnetism from 1° K. to 4° K. was found as shown in FIG. 5, which is a temperature x-axis dependence plot of the reciprocal paramagnetic susceptibility in terms of magnetization (y-axis) of complex (7).

Interestingly, the straight line plotted in this temperature range has a negative Weiss temperature of only −0.4° K. This indicates that the paramagnetic species feel only a very week antiferromagnetic molecular field. Between 0.8° K and 60° mK, the inverse of paramagnetic susceptibilities moved toward the origin when plotted against temperature. In this extremely low temperature region, the spin state seems to change continuously toward the favor of a paramagnetism with a zero Weiss temperature.

IV. USE OF MATERIALS

The high magnetic susceptibilities, which is unusual in an organic system, was observed on $(HMTP)_2$-$TCNQF_4$-$(AsF_x)_{2\text{-}8.1}$ complexes (7). The magnetic properties of these materials at room temperature are comparable to those of nickel oxide, chromium oxide, and iron oxide which are, of course, widely used in magnetic coatings for numerous applications. In any event, the high linearity of magnetic susceptibilities of complexes (7) vs. temperature over a wide range (1° K. to 300° K.) makes these materials applicable, in general, as temperature indicators. For example, they can be used as internal indicators to probe the temperature in a sealed high pressure cell where the connected temperature wires often cause leak of the system. The high magnetic sensitivity of these materials allows the use of them in an amount of only 5–10 mg to bring up the detectable level. In an application, they can be used as composites, suspended pellets, or thin suface coatings. The magnetic susceptibility is measured and the temperature is then read from FIGS. 4 and 5 with the input of the inverse of magnetic susceptibility value.

What is claimed is:

1. A composition of matter having paramagnetic or ferromagnetic properties wherein said composition includes an aromatic organic donor molecule and an aromatic organic acceptor molecule one of which has a three-fold summetry, said donor molecule and acceptor molecule being stacked together, in a mix-stacked form and a dopant with an electron affinity so as to generate a ground state molecule with a triplet character.

2. The composition of claim 1 wherein said acceptor molecule is tetrafluorotetracyanoquinodimethane.

3. The composition of claim 2 wherein said- donor molecule is selected from the group consisting of 2,3,6,7,10,11-hexaalkoxytriphenylene; 2,3,6,7,10,11-hexaaryloxytriphenylene; 2,3,6,7,10,11-hexa-p-alkylaryloxytriphenylene; 2,3,6,7,10,11-triphenylene hexaalkanoate; 2,3,6,7,10,11-tris(N,N'-alkylenediamino) triphenylene; and hexaazaoctadecahydrocoronene, wherein said alkyl, alkoxy and alkanoate groups have from 1 to 13 carbon atoms therein.

4. The composition of claim 3 wherein said donor molecule is 2,3,6,7,10,11-hexamethoxytriphenylene.

5. The composition of claim 3 or 4 wherein said dopant is selected from the group consisting of halogen, $AsF_5$, $SbF_5$ or $NO^+X^-$ wherein $X^-$ is a univalent anion.

6. The composition of claim 5 wherein said dopant is $AsF_5$.

7. A composition of matter comprising a donor molecule and an acceptor molecule, said donor molecule being selected from the group consisting of 2,3,6,7,10,11-hexaalkoxytriphenylene; 2,3,6,7,10,11-hexaaryloxytriphenylene; 2,3,6,7,10,11-hexa-p-alkylaryloxytriphenylene; 2,3,6,7,10,11-tris(N,N'-alkylenediamino) triphenylene; and hexaazaoctadecahydrocoronene, wherein said alkyl, alkoxy and alkanoate groups have from 1 to 13 carbon atoms therein, and said acceptor molecule is tetrafluorotetracyanoquinodimethane, said donor and acceptor molecule being present in a 1:1 ratio and in a mix-stacked form; and a dopant selected from the group consisting of halogen, $AsF_5$, $SbF_5$ or $NO^+X^-$ is a univalent anion.

8. A method for preparing an organic composition of matter having paramagnetic or ferromagnetic properties comprising:

obtaining a composition having an aromatic organic donor molecule and an aromatic organic acceptor molecule, one of which has a three-fold symmetry and which composition is in a mix-stacked form; and contacting the composition obtained with a dopant having an electron affinity capable of generating a molecule with triplet character at a temperature and for a time sufficient whereby said organic composition of matter is prepared.

9. The method of claim 8 wherein said contacting is conducted at ambient temperature for about 1 minute to about 3 hours.

10. The method of claim 9 wherein said composition obtained has a donor molecule selected from the group consisting of 2,3,6,7,10,11-hexaalkoxytriphenylene; 2,3,6,7,10,11-hexaaryloxytriphenylene; 2,3,6,7,10,11-hexa-p-alkylaryloxytriphenylene; 2,3,6,7,10,11-triphenylene hexaalkanoate; 2,3,6,7,10,11-tris(N,N'-alkylenediamino) triphenylene; and hexaazaoctadecahydrocoronene, wherein said alkyl, alkoxy and alkanoate groups have from 1 to 13 carbon atoms therein, an acceptor molecule, said donor and acceptor molecule which is tetrafluorotetracyanoquinodimethane, and said dopant is selected from the group consisting of halogen, $AsF_5$, $SbF_5$ or $NO^+X^-$ wherein $X^-$ is a univalent anion.

* * * * *